United States Patent [19]

Pepa

[11] Patent Number: 5,000,243

[45] Date of Patent: Mar. 19, 1991

[54] BRACKET FOR THE MODULAR CONSTRUCTION OF STRIP-SHAPED CURTAINS

[76] Inventor: Sauro Pepa, Via Mazzini, 22, Camerano (AN), Italy

[21] Appl. No.: 461,110

[22] Filed: Jan. 4, 1990

[51] Int. Cl.[5] ..... A47H 1/00

[52] U.S. Cl. ..... 160/332; 2/311; 2/338

[58] Field of Search ..... 248/317; 160/332; 2/339, 323, 322, 311, 312, 338, 314, 315; 59/82, 84, 85, 87

[56] References Cited

U.S. PATENT DOCUMENTS

| | | | |
|---|---|---|---|
| 594,201 | 11/1897 | Frothingham | 2/338 X |
| 1,001,756 | 8/1911 | Hall | 160/332 |
| 1,392,319 | 10/1921 | Frank | 2/338 |
| 1,431,846 | 10/1922 | Slavens | 2/338 X |
| 1,719,145 | 7/1929 | Stover | 2/338 |
| 1,792,158 | 2/1931 | Gleckner | 2/338 X |
| 1,847,182 | 3/1932 | Heyer | 2/338 X |

FOREIGN PATENT DOCUMENTS

| | | | |
|---|---|---|---|
| 289679 | 10/1931 | Italy | 160/332 |
| 321208 | 9/1934 | Italy | 160/332 |

*Primary Examiner*—David M. Purol
*Attorney, Agent, or Firm*—Leonard Bloom

[57] ABSTRACT

An inverted "U" shaped bracket to be joined to similar brackets. The bracket including two arms. Each arm has a varying width which is greater at a center portion and is narrower at the ends of the respective arm. A slot is formed in each arm and a "V" shaped opening is formed in each arm, the apex of the "V" shaped opening communicating with the slot. The brackets are joined by inserting the arm of the bracket through the V slot in the similar bracket and turning the bracket to engage the arms of the bracket in the slot in the similar bracket.

3 Claims, 1 Drawing Sheet

BRACKET FOR THE MODULAR CONSTRUCTION OF STRIP-SHAPED CURTAINS

FIELD OF THE INVENTION

This present invention concerns a plastic moulded bracket for joining to other brackets of the same type so as to produce a strip-like curtain in different lengths, as required.

It is common knowledge that curtains used for preventing the entry of flies and other insects have become very popular to the extent that new production techniques are developed constantly.

In fact, for many years curtains of this type consisting of chains or cords have been sold very successfully on the market. Though these were fairly effective, they were rather expensive as well as being rather unpractical to produce and clean.

In recent years, strip-like curtains of this kind have been produced by joining modular brackets made of soft plastic. These brackets can be linked together easily in order to produce curtains of any length.

The brackets used to make this type of curtain are very practical and inexpensive, even if, at least in the versions marketed to date, various problems have been encountered.

In fact, each of these brackets has an inverted (i.e., upside down) "U" shaped transverse cross-section consisting of an elongated narrow center part (the base) with longitudinal side arms which are turned downward.

The side arms are tapered outwardly from the base to a center portion at which point the side arms have a width which is approximately double the width at the base. The side arms then narrow gradually from the center portion to the bottom. These two identical arms are turned downwards and are positioned facing each other when in use, so that they remain close together side by side.

Each of these tabs has therethrough an inverted (i.e., upside down) "T" shaped slot at the center. The horizontal section of the "T" shaped slot is slightly greater than the width of the above base of the bracket. The length of vertical arm of the above slot is greater than the maximum length of the bracket arm. The sizes of the "T" slot segments are designed according to the width of the base and the arms of these brackets. The slot must be large enough for another identical bracket to be fitted through the "T" shaped through slot of both adjacent brackets so as to ensure that these are coupled perfectly in series.

The arm of a first bracket must be capable of being fitted vertically through the vertical section of both the adjacent slots of a second bracket. After this arm of the first bracket has been so fitted, the first bracket is turned 90 degrees within the second bracket so that the base of the first bracket slides from the vertical section into the horizontal section of the "T" shaped slots on the adjacent sides of the second bracket. Once this has been done, the two brackets are firmly linked in a perfectly aligned position. By repeating with a sequence of brackets of the same type—used in the same way as rings of a chain—a strip-like curtain can be produced in the length required. As mentioned, the major problem in these brackets is the technique used for fitting an arm of one bracket into the slot of another bracket.

The shape of the slot on the arms in former versions of the bracket is an important aspect to consider because, despite the care with which the sections between the arms and the sizes of the brackets are designed, the rotation of the base, within the inverted "T" shaped slot, from a vertical position to a horizontal position, is very difficult. This is so because the rotation is hindered by the 90 degree angle connecting the vertical and horizontal arms of the inverted "T" shaped slot.

It is obvious that, despite this, the base can be fitted into the slot even with some difficulty. It is important to note that when these curtains are produced at an industrial level, even the smallest practical problem which entails a loss of production time, becomes costly in view of the fact that the operation for hooking the brackets together must be repeated continuously.

SUMMARY OF THE INVENTION

The bracket according to the invention was produced with the intention of overcoming these practical problems which have characterized the former versions of the brackets used for producing curtains of this type.

While maintaining the traditional general structure, the brackets of the present invention consist of two arms turned downwards center having a "V" shaped opening formed near the center of each arm. The apex of the "V" is joined at the center of a slot which is substantially parallel to the base.

It is easy to understand how a "V" shaped opening of this type consists of two symmetrically slanted legs converging towards the center of the slot. The length of each of the two slanted legs of this opening is slightly greater than the maximum width of the arms of the bracket, while the width of the slot is slightly larger with respect to the base connecting the two bracket arms.

It is the very shape of this V-opening of the present invention which facilitates fitting a first bracket into another identical second bracket. In this regard, it should be noted that once the arm of a first bracket has been passed through one of the slanted legs of the "V" opening on the arm of a second bracket, it is extremely simple to slide the base down and to rotate the same to a horizontal position. The rotation occurs at the point where the slanted legs of the "V" opening and the slot intersect.

In particular, it should be noted that, because of this design, the base of the first bracket can be rotated within the "V" opening of the arm of a second bracket more easily since the V-opening no longer has a right angle (as in the prior art) which prevents this part from rotating easily.

For major clarity the description of the invention continues with reference to the enclosed drawings which are intended for illustrative purposes and not in a limiting sense.

DESCRIPTION OF THE PREFERRED EMBODIMENTS

Figure 1:
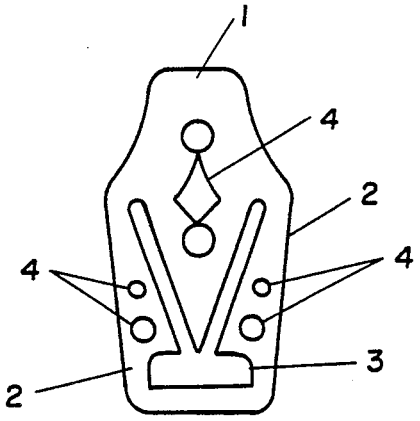
FIG. 1 is the front view of a bracket according to the invention.
Figure 2:
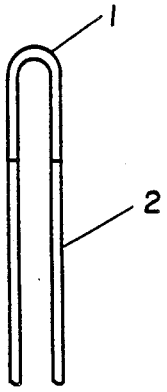
FIG. 2 is the side view of the bracket of FIG. 1.
Figure 3:
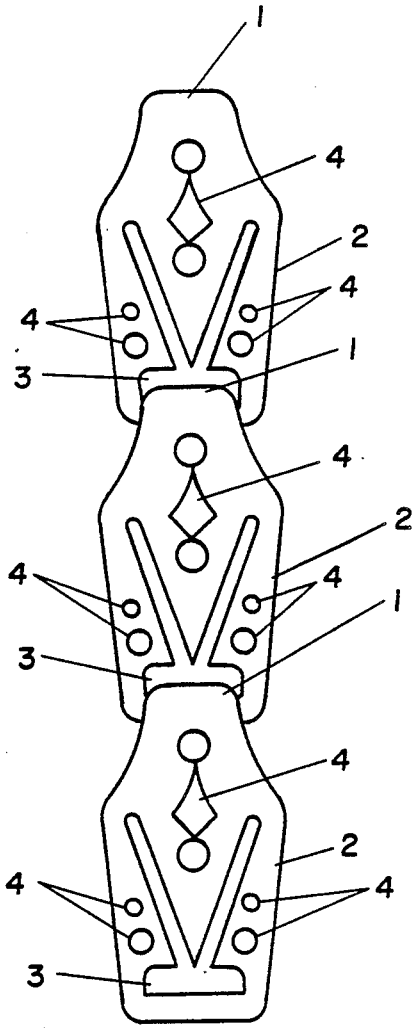
FIG. 3 is the front view of a section of a strip-like curtain made by joining a plurality of brackets according to the present invention.
Figure 4:
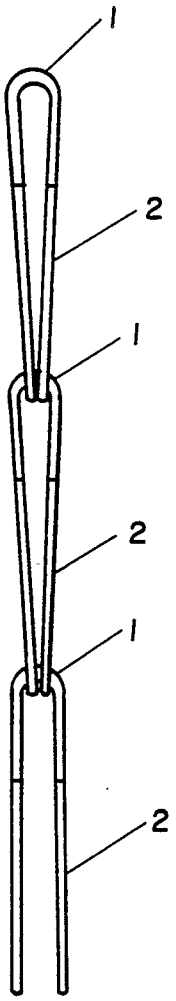
FIG. 4 is the side view of the curtain of FIG. 3.

With reference to the enclosed figures, each bracket is molded in plastic in a single piece. The bracket has an inverted "U" shaped profile and consists of a flat member folded in two to have a base 1 and two identical arms 2. The arms are positioned so that they are close and facing each other. The width of the arm 2 increases from the bottom which is opposite from the base 1. The width increases to a maximum at a point on the arm and the width then decreases to a minimum towards the top where the arms 2 are joined at the base 1. Each of these arms 2 has a "V"-shaped opening therethrough. The "V"-shaped opening has slanted legs therein. The bottom end (apex) of the "V" shaped opening is joined to, and communicates with, the center of the slot 3 in the arm 2. The lengths of the slanted legs of the "V" shaped opening are slightly greater than the maximum width of the arm 2. The slot 3 in the arm 2 is formed near the end of the arm and is substantially parallel to the base 1. The length of the slot 3 is slightly greater than the width of the base 1. Also, additional openings, or cut out portions 4, of any geometric shape or size may be made in the arms 2 for decorative purposes and to reduce the weight of the bracket.

I claim:

1. A bracket to be joined to similar brackets to form a strip like curtain of a desired length, the bracket comprising: a flat member folded in two to form an inverted "U" shape, the "U" shape having a base and two arms, each arm having a respective end extending outwardly from the base, the arms further having a varying width, the width being at a minimum at the base and increasing to a maximum at a point on each arm, the width further decreasing to the end of each arm; a slot being formed near the end of each arm and extending substantially parallel to the base; the slot having a width which in slightly greater than the width of each arm at the base of the "U" shape, a "V" shaped opening being formed in each arm, each "V" shaped opening having a pair of legs and an apex, the respective apex communicating with the respective slot in each arm, each leg of the "V" shaped opening having a length which is slightly greater than the maximum width of the respective arms such that the respective arm of the bracket may be inserted in V slot of the similar bracket and the bracket may be easily turned in the similar bracket to engage the arms of the bracket in slot in the similar bracket such that the bracket is supported in a depending manner from the similar bracket.

2. The bracket of claim 1, wherein the arms are substantially identical.

3. The bracket of claim 1, wherein the bracket has at least one cut out portion therein such that the weight of the bracket may be reduced.

* * * * *